United States Patent [19]

Marlinga et al.

[11] Patent Number: 4,732,025

[45] Date of Patent: Mar. 22, 1988

[54] PRECISION BENDING APPARATUS AND PROCESS

[75] Inventors: Terrance C. Marlinga, Kawkawlin; Gerald R. Trudell, Pinconning, both of Mich.; Jon W. Harwood, Toledo, Ohio

[73] Assignee: AP Industries, Inc., Toledo, Ohio

[21] Appl. No.: 53,084

[22] Filed: May 22, 1987

[51] Int. Cl.[4] ..... B21C 51/00; B21D 7/12; B21D 7/14; B21D 9/05

[52] U.S. Cl. ..... 72/15; 72/31; 72/150

[58] Field of Search ..... 72/8, 10, 11, 12, 14, 72/15, 22, 31, 34, 149, 150, 154, 155, 307, 702

[56] References Cited

U.S. PATENT DOCUMENTS

| | | | |
|---|---|---|---|
| 3,553,989 | 1/1971 | Munro et al. | 72/8 |
| 3,776,764 | 10/1973 | Ross et al. | 72/8 X |
| 3,821,525 | 6/1974 | Eaton et al. | 72/8 X |
| 4,262,509 | 4/1981 | Schwarze | 72/10 |
| 4,563,802 | 1/1986 | Benteler et al. | 72/34 X |

*Primary Examiner*—E. Michael Combs

*Attorney, Agent, or Firm*—Anthony J. Casella; Gerald E. Hespos

[57] ABSTRACT

A precision bending apparatus is provided for precisely bending tubes. The precision bending apparatus includes a preprogrammed bender for placing a selected sequence of bends in the tube. The apparatus further includes a position sensing means for sensing the precise position of locations on the bent portion of the tube. A control means is in communication with both the position sensing means and the bender, and is operative to alter the program of the bender based on data sensed by the position sensing means.

12 Claims, 4 Drawing Figures

PRECISION BENDING APPARATUS AND PROCESS

BACKGROUND OF THE INVENTION

Tubular metal products are widely used in the automotive industry. In particular, metallic tubes comprise a principal part of vehicular exhaust systems which carry exhaust gases from the vehicular engine to a safe and convenient location from which the exhaust gases may be dispersed. Rectangular metal tubes also are employed to manufacture frames for trucks and other vehicles.

Tubes incorporated into a vehicle generally must be bent at several places along their lengths to avoid or to meet other parts of the vehicle. For example, tubes which carry exhaust gases from the engine typically undergo several complex bends within the engine compartment to bypass other engine components and accessories. Two or more exhaust pipes on a vehicle may bend to join with one another, and then may bend several more times to avoid the passenger compartment, an axle, a gas tank, a trunk or the like. Tubes used in frames must similarly be bent to avoid or precisely mate with other structural components on the vehicle.

Tubes typically are bent with a preprogrammed automatic bending apparatus. The bending apparatus typically will include gripping means for gripping the trailing end of the tube. The gripping means is operative to selectively advance the tube preprogrammed distances in an axial direction, and to selectively rotate the tube preprogrammed amounts about the initial longitudinal axis. The bending apparatus further includes a bending die, a portion of which defines an arc of a circle. More particularly, the arced portion of the bending die is further configured to define a groove dimensioned to receive the outer surface of the tube. For example, the groove in the arced portion of the bending die will typically be of generally semicircular configuration with a radius substantially equal to the outside radius of a circular tube to be bent. A bending die for rectangular tubes may have a corresponding rectangular groove. The bending die is mounted in the apparatus for preprogrammed rotation about a point coincident with the center of rotation of the arced outer surface.

The bending apparatus further includes a clamp die which is dimensioned and configured to securely hold a portion of the tube against the bending die. The clamp die is also mounted to the apparatus for rotation about the center of rotation of the arced portion of the bend die.

The bending apparatus further includes a pressure die which initially is aligned with the clamp die and is urged tightly against the tube. Unlike the clamp die, the pressure die does not rotate around the center of rotation of the arced portion of the bend die.

In operation, the tube to be bent is axially advanced to a preselected position relative to the bend die and is securely held against the bend die by both the clamp die and the pressure die. The clamp die and the bend die will then rotate a preprogrammed amount about the center of rotation of the arced portion of the bend die, while a movable section of the pressure die generally will follow the arc length in a controlled manner. This rotational movement of the clamp die and bend die will cause the tube to be bent an angular amount substantially equal to the degree of angular rotation by the clamp die and bend die. After a bend of a predetermined amount is completed, the tube will be released, and the clamp die, bend die and pressure die will return to their initial position. Simultaneously, the tube will be moved by the gripping means both axially and rotationally into position for completing the next bend. For most automotive uses, each tube will receive several successive bends of different angular amounts and disposed at different angular alignments relative to one another.

Certain bending devices will further include a mandrel within the tube to ensure a smooth bend, a booster to move the pressure die tangentially to feed tubular material into the bend and prevent excessive thinning, and a wiper die to minimize wrinkles on the inside portion of the bend.

There are many programmable bending devices available which will accurately advance the tube both axially and radially toward the bend die and which will accurately complete preprogrammed movements of the clamp die and bend die. Despite this accurate performance of the available bending equipment, there are often substantial differences among the bent tubes produced by the devices. In some situations, minor variations from one bent tube to the next can be tolerated. In other situations, however, even these minor variations from one part to the next create problems. For example, many new car assembly processes are being automated, and the automated assembly equipment or robots require substantial uniformity from one part to the next. This applied to both new car exhaust systems and to tubular frames for vehicles. In other situations, the close proximity of the tubular product to other vehicular components provides little room for variation. This is particularly true for exhaust systems which, by definition, carry heated exhaust gases. It is often essential to carefully control the spacing between the heated exhaust pipes and adjacent components of the vehicle, such a floorboards, fuel lines and hydraulic lines for brakes or steering. The ability to accurately and consistently produce bent tubular members within the precise specifications often must be carefully documented. The tube manufacturer generally must follow and document a particular statistical produce control (SPC) method.

In view of the greater accuracy being required for tubular products, the reasons for differences between successive parts have been studied. It has been found that one reason for variations from one bent pipe to the next is attributable to variations in the metallurgical characteristics plus material thickness and/or dimensional variations of the tubular products. More particularly, metallurgical variations will cause successive tubular products to respond differently to the forces exerted by the bending apparatus. Thus, although virtually all tubes exhibit spring-back upon release of the clamp die, the amount of spring-back can vary substantially from one tube to the next. Furthermore, it has been found that the rapid movement of the portions of the tube that have already passed through the bending apparatus will create additional rotational moments that may cause other unanticipated bends in the tubes, the magnitude of which will depend upon the length and mass of the tube, the speed at which the bending apparatus is operating and the metallurgical and dimensional characteristics of the particular tube being bent. These variations may compound one another along the length of the tube to yield substantial differences between the specified and actual shapes of the tube.

In view of the above, it is an object of the subject invention to provide an apparatus to precisely bend tubular products.

It is another object of the subject invention to provide a bending apparatus that will enable accurate bends despite variations in the metallurgical characteristics of successive tubes.

An additional object of the subject invention is to provide an apparatus that will control successive bends in accordance with variations from a preselected alignment for the bent tubular product.

SUMMARY OF THE INVENTION

The subject invention is directed to an apparatus for precisely bending tubes which may be of circular, rectangular or other cross-sectional configuration. The apparatus comprises a programmable bender for placing a plurality of successive controlled bends in an elongated tube, position sensing means for sensing the actual position of at least one portion of the tube that has been previously bent, and control means in communication with the programmable bender and the position sensing means.

The programmable bender includes means for gripping one end of a tube and advancing the tube preprogrammed amounts both axially and rotationally. The bender further comprises a bend die having an arcuate outer surface and a clamp die for clamping a portion of the tube against the bend die. The bender further includes rotating means for rotating the clamp die and the bend die about the center of the arcuate portion of the bend die. The rotating means is operative to move the clamp die and bend die predetermined amounts. However, the rotating means can be overridden by the control means of the apparatus as described herein.

The position sensing means may comprise at least one feeler or end effector for mechanically or electromechanically sensing the position of at least one location along the length of the tube. Alternatively, the position sensing means may comprise a light source, such as a laser source, which is operative to precisely detect the actual position of at least one selected location along the tubular product. The position sensing means may further comprise a robotic assembly to which the feeler, end effector, light apparatus or such may be mounted. The robotic apparatus may include a plurality of articulated arms which are preprogrammed to move through a selected array of movements to place the feeler, end effector, light apparatus or such in a proper spatial location for sensing the position of at least one location along the tubular product. The position sensing means may further comprise a support to which the robotic apparatus and/or the feeler, end effector, or light apparatus may be mounted. The support base may in turn be movable along a track or guideway to achieve a proper range for the position sensing means relative to the bending apparatus.

In one embodiment, the position sensing means may be operative to sense the presence of the end of the partially bent tube. More particularly, the position sensing means may advance to a preprogrammed position corresponding to the required position for the bent end of the tube at the completion of a selected bend therein. The position sensing means may then be operative to produce a signal when the tube has reached the predetermined position, thereby indicating that the bender has traversed an arc of sufficient magnitude. The position sensing means will then advance to another preprogrammed position corresponding to the specified location of the tube at the completion of the next sequential bend to be performed by the bending apparatus.

The control means of the subject apparatus preferably is in communication with both the bender and the positioning sensing means. The control means may direct the position sensing means sequentially to preselected locations upon completion of each bend by the bender. Additionally, the control means may be operative to alter the initial program of the bender based on the data sensed by the position sensing means. Thus, for example, the control means may direct the bender to stop a bend earlier than initially programmed if the position sensing means determines that the one or more selected locations along the tube have already reached their specified position. Conversely, the control means may direct the bender to advance further if the position sensing means determines that the one or more locations along the tube have not yet reached their specified position.

The control means may further comprise a printer which is operative to document the final precise position of at least the opposed ends of the tube relative to one another. This printed document could be produced for each bent tube or for a selected statistically significant sampling. The printed document would enable a comparison between actual and specifed bent configurations and could be incorporated into the SPC reporting required by most vehicle manufacturers.

DETAILED DESCRIPTION OF THE PREFERRED EMBODIMENT

Figure 1:
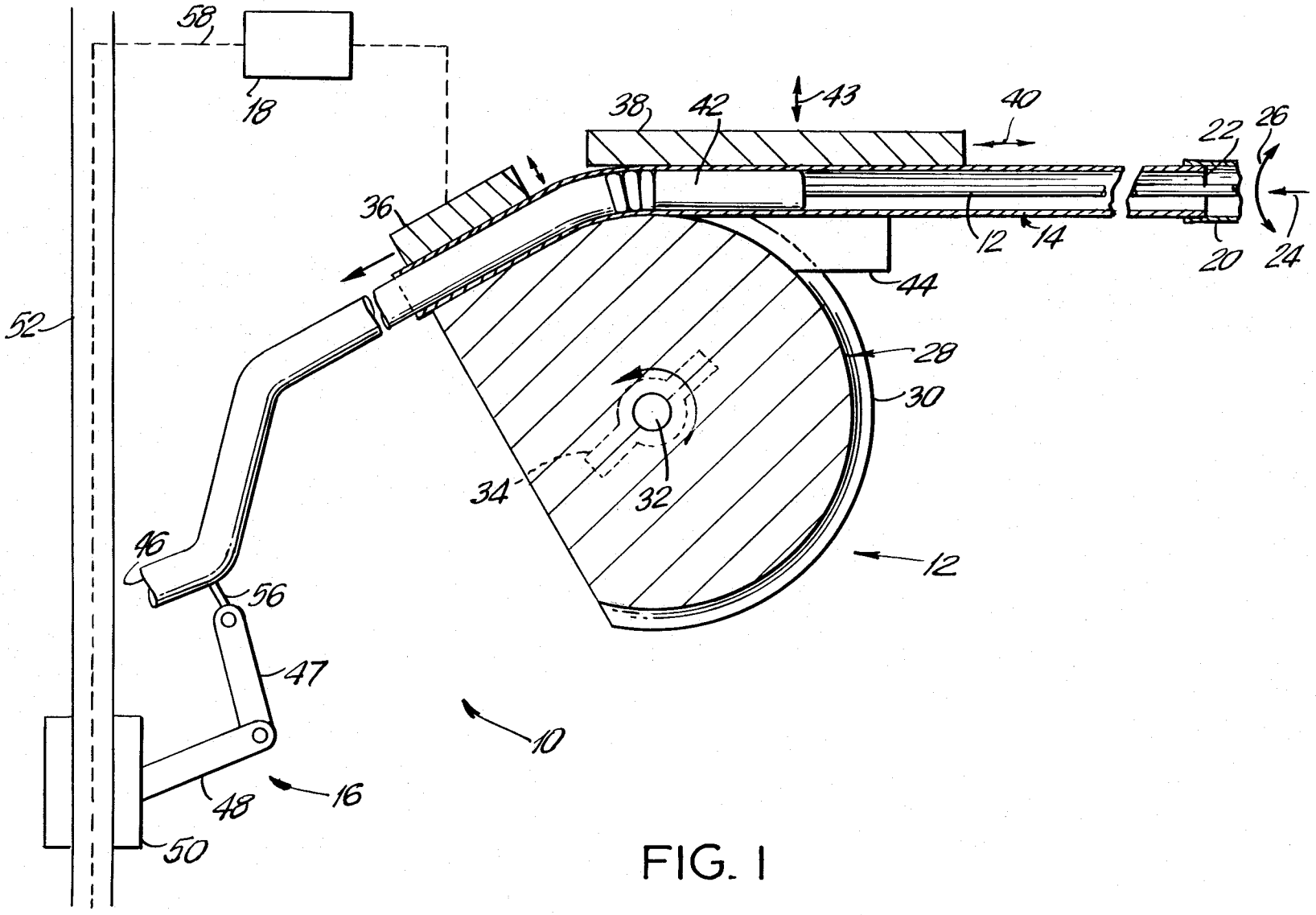
FIG. 1 is a cross-sectional view of the precision bending apparatus of the subject invention.

The precision bending apparatus of the subject invention is indicated generally by the numeral 10 in FIG. 1. More particularly, the precision bending apparatus 10 includes a bender 12 for bending a tube 14, a position sensing device 16 and a control 18. The bender 12 includes a gripping means 20 which is operative to securely grip the trailing end 22 of the tube 14. The gripping means 20 is also operative to selectively move the tube 14 in an axial direction as indicated by the arrow 24 and to selectively rotate the tube 14 as indicated generally by the arrow 26. Thus, the gripping means 20 is able to alter both the axial position and rotational alignment of the tube 14 with respect to the remainder of the precision bending apparatus 10.

Figure 2:
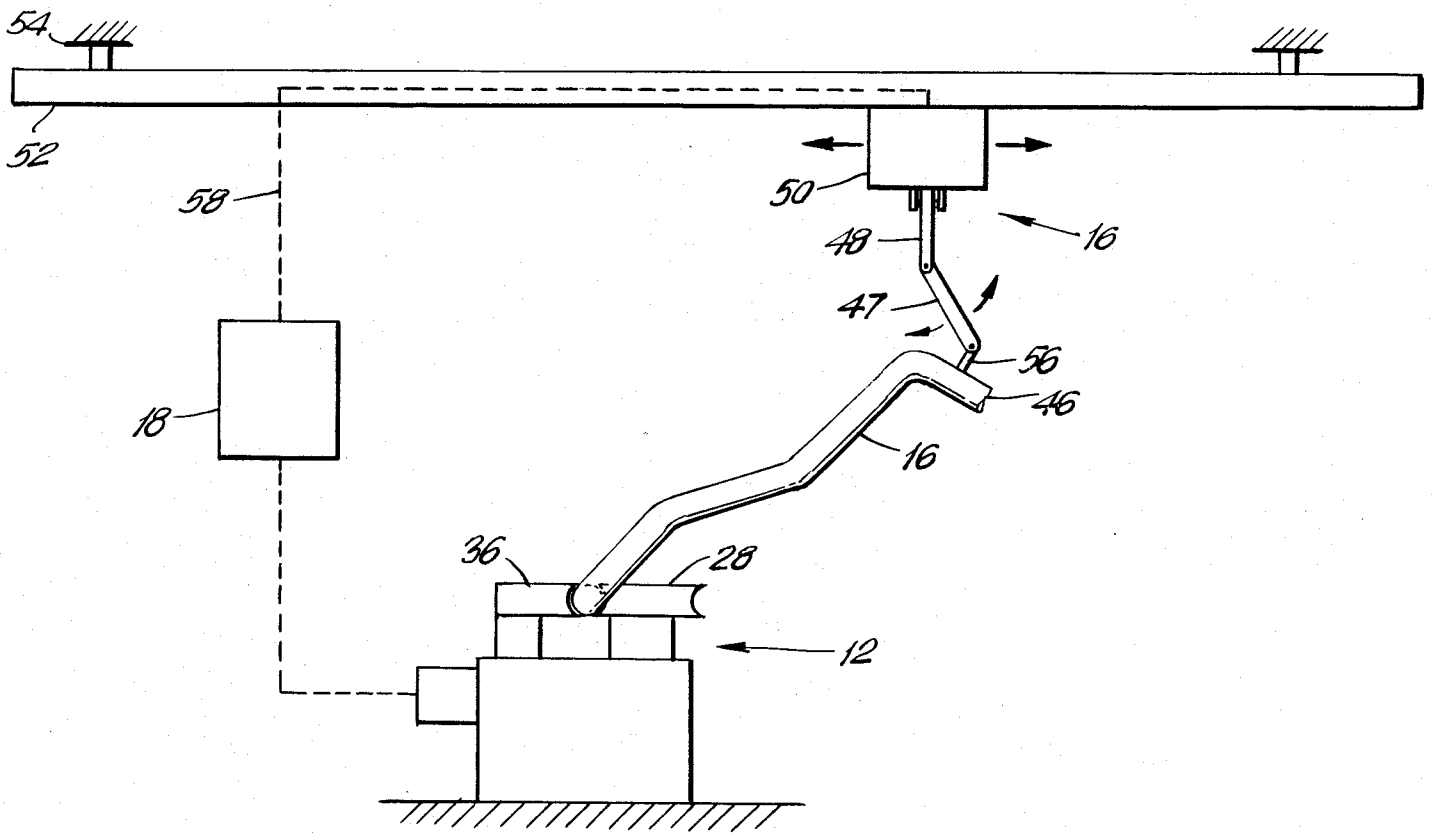
FIG. 2 is an elevational view of the precision bending apparatus of the subject invention.

The bender 12 of the precision bending apparatus 10 further comprises a bend die 28 which includes an outer surface 30 generally defining an arc of a circle. As shown more clearly in FIG. 2, the outer surface 30 is configured to reflect the outer cross-sectional configuration of the tube 14 to be bent. Thus, as shown in FIGS. 1 and 2, the outer surface 30 of the bend die 28 is of generally semicircular configuration to securely engage the outer surface of tube 14. In situations where the tube 14 is noncircular (e.g. rectangular), the outer surface 30 of bend die 28 will have a compatible cross-sectional configuration. The bend die 28 is operative to be rotatably driven around the center 32 of the generally circular outer surface 30 by a drive key 34 or other similar driving mechanism.

The bender 12 further includes a clamp die 36 which is operative to move in a generally radial direction with respect to the center 32 of the bend die 28 to securely grip the tube 14 against the bend die 28. Additionally, the clamp die 36 is operative to rotate about the center 32 of the bend die.

The bender 12 further includes a pressure die 38 which is operative to hold the tube 14, but which is not operative to rotate about the center 32 of the bend die 28. More particularly, the pressure die 38 may be operative to move in a generally tangential direction, as indicated by arrow 40, to feed the tube 14 into the bend, and thereby prevent excessive thinning on the outside of the bent tube. The bender 28 further includes a mandrel 42 which is inserted into the tube 14 and is positioned approximately at the point of the bend, and a wiper die 44 which is positioned external to the tube 14 and adjacent the bend die 28. The mandrel 14 and the wiper end 44 are both operative to prevent wrinkles in the tube 14 as a result of the bend.

In operation, the clamp die 36 and the pressure die 38 are both moved radially away from the bend die 28 as shown by arrow 43 to permit placement of the tube 14 therein. Additionally, the clamp die 36 and the bend die 28 are rotated about the center 32 such that the clamp die 36 and the pressure die 38 are adjacent one another and generally collinear. The tube 14 then is positioned with its leading end 46 in proximity to the bend die 28. Additionally, the mandrel 42 is slidably inserted within the tube 14 and the trailing end 22 of the tube 14 is securely engaged in the gripping means 20. The gripping means 20 then moves the tube 14 in an axial direction, as indicated by arrow 24 such that the specified location of the first bend in the tube 14 is properly positioned with respect to the bend die 28 and clamp die 36. The clamp die 36 and the pressure die 38 then move radially inwardly to securely engage the tube 14 against the bend die 28. The clamp die 36 and the bend die 28 will then rotate a preprogrammed amount about center 32 to place the first required bend in the tube 14. The pressure die 38 may simultaneously advance in a tangential direction toward the clamp die 36 under the action of a booster (not shown) to effectively feed the tube 14 into the bend and prevent excessive thinning on the outer portion of the bend.

As the tube 14 is bent under the action of the clamp die 36 and bend die 28, the leading end 46 will move through a circular arc. At the completion of the bend, the leading end 46 should be in a predetermined position that can be readily calculated based on the degree of rotation about center 32 and the spatial position of leading end 46 just prior to commencement of the bending operation. As will be explained further below, the actual location of the leading end 46 will be determined by the position sensing means 16. Before turning to the discussion of the position sensing means 16, however, it should be noted that after a bend into 14 is completed, the clamp die 36 and the bend die 38 will move radially outwardly relative to center 32, and the clamp die 36 and bend die 28 will rotate back to their initial position. The clamp means 20 will then move the tube 14 axially and rotationally as indicated by arrows 24 and 26 for proper alignment of the next sequential bend to be placed in the tube 14.

The position sensing means 16 includes an array of robotic arms 47, 48 which are pivotably connected to one another and pivotably mounted to a support 50. The support 50 in turn is mounted to a track 52, which as shown in FIG. 2, preferably is mounted to an overhead support structure 54, such as the ceiling of the building within which the precision bending apparatus 10 is disposed. In other embodiments, the track 52 may be supported to floors, walls or the like. In still other embodiments, the support 50 may be stationary, may be an integral part of the bender, or may be movable independent of a fixed track.

A sensor 56 is mounted to the end of the robotic arm 47, and is operative to sense the presence of a selected location along tube 44, and preferably a location adjacent the leading end 46. As shown in FIGS. 1 and 2, the sensor 56 may be an electromechanical feeler. In this embodiemnt, when the feeler portion of the sensor 56 is contacted by the tube 14, an electrical signal will be generated.

The position sensor 16 is in electrical communication with the control means 18. The control means 18 also is in communication with the bender 12. The electrical connection between the position sensor 16 and the control means 18 is indicated by the dashed line 58 which may be a helically coiled wire permitting movement of the support 50 along the track 52.

The control means 18 preferably is a microprocessor which is operative to alter the preprogrammed bending instructions for the bender 12 in accordance with the data sensed by the position sensing means 16. In particular, the control means 18 will instruct the bender 12 to continue bending the tube 14 beyond its preprogrammed amount if the sensor 56 has not sensed the presence of the tube 14. Conversely, the control means 18 may terminate the operation of the bender 12 short of its preprogrammed rotation if the sensor 56 senses the presence of the tube 14 before the clamp die 36 and bend die 28 have completed their preprogrammed rotation. Thus, the control means 18 in combination with the position sensor 16 and the bender 12 will ensure that the actual bent configuration of the tube 14 closely matches the specified configuration, notwithstanding variations in the metallurgical characteristics, material thickness or tubing dimensional characteristics of successive tubes 14.

As noted above, one of the significant causes for variations between bent tubes is the spring-back which occurs after the release of tube 14 by clamp die 36 and pressure die 38. As noted above, this spring-back reflects the resiliency of the metallic material of tube 14 which may vary from one tube to the next depending upon the specific metallurgical or physical characteristics. The control means 18 of the precision bending apparatus 10 may be specifically programmed to sense spring-back and make appropriate adjustments as necessary. Thus, the bender 12 may be operative to release the clamp die 36 prior to releasing the pressure die 38. The position sensing means 16 and the control means 18 may then be operative to sense whether any spring-back movement of the tube 14 occurs. The magnitude of this movement may be sensed by moving the robotic arms 47, 48 and the feeder 56. If the amount of spring-back exceeds a preselected amount, the control means 18 may signal the clamp die 36 to grip the tube 14 again, and then may signal the bend die 28 and clamp die 36 to complete additional rotation to offset the spring-back.

The control means 18 may further comprise a printer for documenting the actual sensed position of one or more locations on the tube 14 at the completion of the bending process. The actual documented positions can be compared to specifications to ensure quality control. The documentation can be produced at selected intervals in accordance with a particular statistical product control methodology, and the documentation can be provided to the purchaser of the bent tubes.

Figure 3:
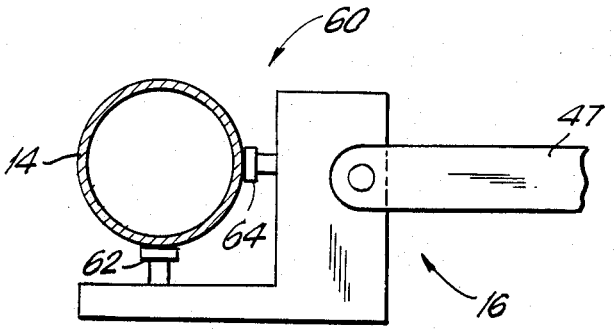
FIG. 3 is an elevational view of a position sensing means in accordance with the subject invention.

FIG. 3 shows an alternate embodiment of an electromechanical feeler which is indicated generally by the numeral 60 and which could be incorporated into the position sensing means 16 schematically illustrated in FIGS. 1 and 2. The feeler 60 comprises two electromechanical feelers 62 and 64 which are angularly spaced from one another preferably by approximately 90°. Each electromechanical feeler 62 and 64 defines a switch means similar to the feeler 56 described above with reference to FIGS. 1 and 2. These feelers 62 and 64 will move in response to contact by the tube 14, and this movement will generate an electrical signal indicating the presence of the tube 14. The use of two angularly disposed feelers 62 and 64 will provide greater precision as to the location of the tube 14.

Figure 4:
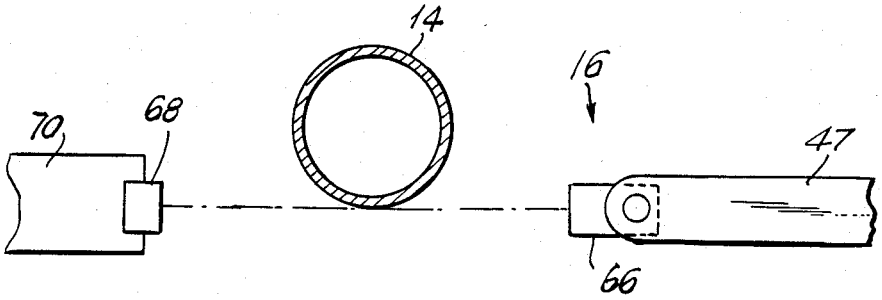
FIG. 4 is an elevational view of an alternate position sensing means.

FIG. 4 shows still another alternate of the position sensing means 16 wherein an electro-optical device 66 is mounted to the end of robotic arm 47. The electro-optical device 66 is employed in conjunction with a photodetector 68 mounted to support 70. The support 70 may also be mounted to robotic arm 47. Alternatively, the photodetector 68 may be mounted to a separate robotic arm (not shown) the movement of which is dictated by control means 18. As still another alternative, the photodetector 68 may be generally stationarily mounted in a location relative to the light sourve 66. In combination, the light source 66 and the photodetector 68 will be operative to sense the position of a specific location on the tube 14. In particular, the robotic arm 47 may move to place the light source 66 in a location relative to the photodetector 68 such that a beam of light directed from light source 66 to the photodetector 68 will be interrupted at the instant the tube 14 moves into its specified bent alignment. The interruption of the light signal sensed by the photodetector 68 will generate an electrical signal that will be sensed by the control means 18. Although various types of light from light source 66 will function in this embodiment, it is anticipated that a low power laser beam and in particular an infrared laser beam will be most effective.

In summary, a precision bending apparatus is provided for bending tubular materials. The precision bending apparatus include a preprogrammed bender for bending the tube specified amounts. The apparatus further includes a position sensing means for sensing the precise position of one or more locations along the previously bent portions of the tube. A control means also is provided and is in communication with both the bender and the position sensing means. The control means is operative to alter the preprogrammed bending instructions based on data sensed by the position sensing means. The position sensing means may include one or more electromechanical feelers to sense the location of the tube. Alternatively, the position sensing means may employ photo-optical means to sense the location of the tube.

While the invention has been described with respect to certain preferred embodiments, it is apparent that various changes can be made without departing from the scope of the invention as defined by the appended claims.

What is claimed is:

1. An apparatus for precisely bending an elongated tube having opposed leading and trailing ends into a specified bent configuration, said apparatus comprising:

a preprogrammed bender comprising means for gripping the trailing end of the tube and moving said tube axially and rotationally preprogrammed amounts, and die means for sequentially bending said tube preprogrammed amounts to form a plurality of bends in said tube;

positioning sensing means for sensing the spatial position of at least one predetermined location between the leading end of the tube and one said bend, said position sensing means being operative to move to preprogrammed locations after the formation of each bend by the bender; and control means for altering the preprogrammed bending operations of the bender in response to the spatial positions of said tube sensed by said position sensing means such that the bender bends the tube precisely into the specified configuration.

2. An apparatus as in claim 1 wherein the position sensing means comprises at least one electromechanical switch for sensing the presence of the tube.

3. An apparatus as in claim 2 wherein the position sensing means comprises a plurality of electromechanical switches for sensing the presence of the tube.

4. An apparatus as in claim 1 wherein the position sensing means comprises an electro-optical means for sensing the presence of the tube.

5. An apparatus as in claim 4 wherein the position sensing means comprises a laser light source and a photodetector.

6. An apparatus as in claim 1 wherein the position sensing means is operative to sense the spatial position of a location substantially adjacent to the leading end of the tube.

7. An apparatus as in claim 1 wherein the position sensing means comprises a plurality of arms pivotally connected to one another.

8. An apparatus as in claim 1 further comprising a track, said position sensing means being movable along said track.

9. An apparatus as in claim 1 wherein the control means comprises printout means for documenting the actual sensed spatial position of said at least one location after the formation of said plurality of bends in said tube.

10. An apparatus for precisely bending an elongated tube into a specified configuration, said tube having opposed leading and trailing ends, said apparatus comprising:

a preprogrammed bender comprising gripping means for gripping the trailing end of the tube and moving said tube axially and rotationally preprogrammed amounts, and die means for bending said tube preprogrammed amounts to form a plurality of bends in said tube, said gripping means and said bending means being operative sequentially relative to one another;

positioning sensing means for sensing the spatial position of at least the leading end of the tube, said position sensing means being operative to move to preprogrammed locations after each bending operation of the die means; and control means for altering the preprogrammed bending operations of the bender in response to the spatial positions of said tube sensed by said position sensing means such that the bender bends the tube precisely into the specified configuration.

11. A method for precisely bending an elongated tube into a specified configuration with a preprogrammed bender which is operative to bend said tube into a configuration approximating said specified configuration, said process comprising the steps of:

providing an elongated tube having opposed leading and trailing ends;

placing said tube in said preprogrammed bender;

operating said preprogrammed bender to place successive preprogrammed bends in said tube;

sensing the spatial position of said tube approximately adjacent said leading end approximately when said preprogrammed bender is completing selected ones of said bends; and successively altering the preprogrammed bending operation of said bender based on each sensed spatial position of said tube.

12. A method as in claim 11 further comprising the step of documenting the sensed spatial position of said tube after completion of said bending.

* * * * *